United States Patent [19]

Levin

[11] Patent Number: 4,854,056

[45] Date of Patent: Aug. 8, 1989

[54] UNIVERSAL SHOE SLING

[76] Inventor: Eleanor B. Levin, Box 223, R.D. Country Club Rd., Herkimer, N.Y. 13350

[21] Appl. No.: 125,217

[22] Filed: Nov. 25, 1987

[51] Int. Cl.[4] ..... A43B 23/28; A43B 3/12

[52] U.S. Cl. ..... 36/58.5; 36/11.5

[58] Field of Search ..... 36/58.5, 58.6, 100, 36/101, 11.5, 1 R, 136

[56] References Cited

U.S. PATENT DOCUMENTS

| | | | |
|---|---|---|---|
| 1,196,281 | 8/1916 | Quarters | 36/58.5 |
| 1,655,715 | 11/1928 | Sweeston | 36/58.5 |
| 1,690,690 | 11/1928 | Miller | 36/58.5 |
| 2,214,085 | 9/1940 | O'Neill | 36/1 |
| 2,495,984 | 1/1950 | Roy | 36/15 |
| 3,570,147 | 3/1971 | Chiu | 36/2.5 |
| 4,193,214 | 3/1980 | Wang | 36/11.5 |
| 4,267,649 | 5/1981 | Smith | 36/101 |
| 4,461,102 | 7/1984 | DeVincentis | 36/101 |

FOREIGN PATENT DOCUMENTS

| | | | |
|---|---|---|---|
| 1037252 | 8/1978 | Canada | 36/11.5 |
| 429256 | 12/1926 | Fed. Rep. of Germany | 36/58.5 |
| 856865 | 11/1952 | Fed. Rep. of Germany | 36/100 |
| 57856 | 3/1922 | Sweden | 36/58.5 |

OTHER PUBLICATIONS

"Self Adhering Nylon Tapes", Journal of the AMA., vol. 168, No. 7, M. Gershman M.D., Cl 2, Dig. 6, 10/1958.

*Primary Examiner*—Steven N. Meyers

*Attorney, Agent, or Firm*—Wall and Roehrig

[57] ABSTRACT

A universal shoe sling for employment with a conventional shoe, having a strap member or members attached to a shoe heel engagement means such as a loop member or a pair of loop members. The heel engagement means is configured and dimensioned to slidably engage the heel of a conventional shoe. The strap member or members are positioned and configured to wrap-around the sides of the shoe and of the shoe wearer's foot, seated within the shoe. The strap member or members, in cooperation with the heel engagement means, secure the wearer's foot to the sole of the shoe. The inventive shoe sling is universal in that it is employable with many types of conventional shoes.

20 Claims, 2 Drawing Sheets

UNIVERSAL SHOE SLING

BACKGROUND OF THE INVENTION

The present invention pertains to the field of art involving footwear, shoes and interchangeable shoe slings or straps, and more particularly to a shoe sling or strap that is not dependent upon a specially designed shoe. The present invention relates to a substantially universal shoe sling in that it may be employed with many conventional shoe designs, and is not dependent upon special shoe design.

Certain footwear, and particularly a women's slip-on type of shoe, having no rear upper portions thereto, and sometimes colloquially referred to as a "mule", can become very unstable depending on the condition of the walking surface and the activities engaged in by the wearer.

It is well known that shoe straps attached to the shoe may provided added support for the wearer. However, permanently attached straps necessarily alter the style and appearance of the shoe, and this may be undesirable.

Heretofore, numerous efforts have been made to develop removable and interchangeable straps for shoes and other footwear. However, these efforts have been directed to ornamental and style considerations, rather than support and stability considerations. The following patents disclose such devices: U.S. Pat. No. 2,495,984 to Roy; U.S. Pat. No. 3,570,147 to Chiu; U.S. Pat. No. 4,193,214 to Wang; U.S. Pat. No. 4,267,649 to Smith; U.S. Pat. No. 4,461,102 to DeVincentis. Each of the footwear disclosed in these patents require a specially designed sole, upper and/or strap. Thus, if one desired the advantage of interchangeability that these devices provide, the specially designed soles, uppers and/or straps must be utilized. Such specially designed footwear components necessarily increased the manufacturing costs and resulting costs to consumer.

SUMMARY OF THE INVENTION

The invention, as claimed, is intended to provide a remedy. It overcomes the problems and satisfies the needs previously indicated. The invention, as claimed, solves the problem of how to provide stability and support to the wearer of conventional footwear without altering the design, style and appearance of the footwear. In addition, it solves the problem of how to provide such stability and support to conventional footwear by employing a shoe sling substantially universal to many conventional shoe designs.

The invention, as claimed, is substantially universal in that it can be used with many conventional shoes in the wearer's wardrobe. In addition, it is an optional item, to be employed with a conventional shoe only when desired. Further, the invention, as claimed, does not require any specially designed sole, sling, strap or upper, and therefore does not cause an increase in the cost of producing footwear. Moreover, the invention, as claimed, provides an optional ornamental accessory to an otherwise conventional shoe.

In particular, the invention, as claimed, involves the use of a shoe sling for employment with a conventional shoe. The inventive shoe sling comprises at least one loop member for engaging the heel of a conventional shoe, and at least one strap member connected to and cooperating with the loop member or members. The strap member or members are configured and dimensioned to wraparound the shoe wearer's foot and secure it to the shoe.

BRIEF DESCRIPTION OF DRAWINGS

One way of carrying out the invention is described in detail below with reference to drawings which illustrate four specific embodiments, in which.

DESCRIPTION OF THE PREFERRED EMBODIMENTS

Figure 4:
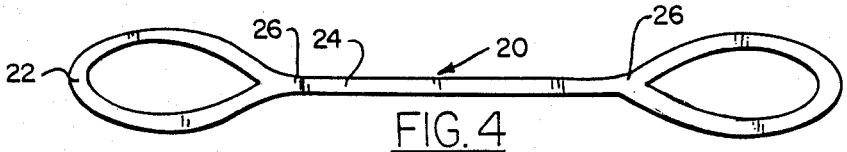
FIG. 4 is a top view of a shoe sling constructed in accordance with the present invention, showing a single strap member.

Referring to FIG. 4, a universal shoe sling can be constructed in accordance with the present invention as illustrated. The inventive shoe sling designated generally 20 is provided with a pair of loop members 22 and a strap member 24. Strap member 24, contains generally a pair of ends 26, is situated between loop members 22, and is attached to each loop member 22 at ends 26, as shown in FIG. 4.

Figure 2:
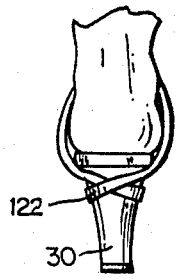
FIG. 2 is a rear elevation view of a shoe sling constructed and employed in accordance with the present invention.
Figure 1:
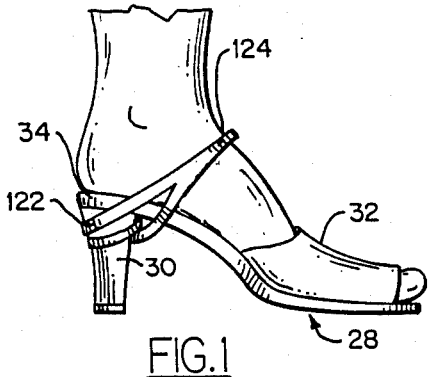
FIG. 1 is a side elevation view of a shoe sling constructed and employed in accordance with the present invention.
Figure 3:
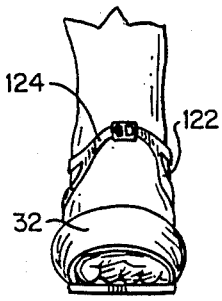
FIG. 3 is a front elevation view of a shoe sling constructed and employed in accordance with the present invention.

Shoe sling 20 secures the wearer's foot to a conventional shoe, as illustrated in FIG. 1. The use of shoe sling 20 is not dependent upon any specially designed heel, upper or sole of the shoe; it is employable with many different types and brands of conventional shoes; one such shoe, designated generally as 28, is illustrated in FIGS. 1, 2 and 3.

Shoe 28 contains a heel 30, an upper 32, and a sole 34.

Loop members 22 are configured and dimensioned to slip over heel 30 of shoe 28 to bind strap member 24 and prevent it from being displaced from a close securing fit with the shoe wearer's foot in shoe 28. Loop members 22 cooperate with heel 30 of shoe 28 to produce the necessary binding force to hold strap member 24 in place.

Strap member 24 is configured and dimensioned to wraparound the wearer's foot while seated in shoe 28, and cooperates with loop members 22 to secure the wearer's foot to the shoe.

Shoe sling 20, in accordance with the present invention, acts to secure the wearer's foot to shoe 28 by strapping the foot down to sole 34 of shoes 28 with strap member 24, in cooperation with loop members 22, as shown in the side elevation view of FIG. 1.

Shoe sling 20 can be constructed of any flexible or resilient material, or fabric material, such as leather, rubber, nylon, or polyester. The enumeration of these materials is not to be construed as inclusive, but only as typical examples of materials that can be used to construct the present invention.

Shoe sling 20, in accordance with the present invention, may be fabricated by first constructing loop members 22 from straight strips of material; and second, fastening the loops to a straight strap member, such as strap member 24. In another approach, shoe sling 20 can be constructed from one strip of material, whereby the ends of the strip are looped and fastened to a point along the strip of material, thereby producing two end loops on opposing sides of the strip of material. It is to be understood that other fabrication techniques are possible and the discussion of two such techniques are presented only for example.

One way of employing shoe sling 20 with shoe 28 is by slipping one loop member 22 over heel 30, then while the wearer's foot is seated in shoe 20, strap member 24 and the other loop member 22 is brought over to traverse both shoe 28 and the wearer's foot. Finally, strap member 24 and the other loop member 22 are pulled and stretched such that the other loop member 22 is capable of being slipped over heel 28, as illustrated in FIGS. 1 and 2.

Figure 5:
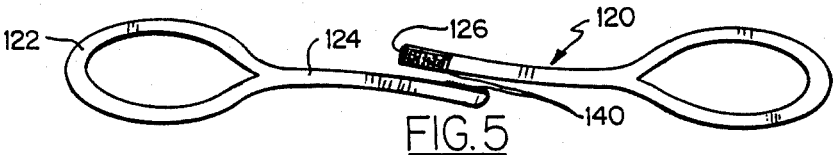
FIG. 5 is a perspective view of a shoe sling constructed in accordance with the present invention, showing the strap member in two parts and having a clasping means to join the two parts.

Referring to FIG. 5, it can be seen that shoe sling 20 can be modified such that the single strap member between the loop members is divided into two strap members 124. Each strap member 124 is attached to a respective loop member 122.

In application, shoe sling 120 is employed with shoe 28 by first slipping both loop members 122 over heel 30, and then pulling each strap member 124 up and around the opposing sides of show 28 and over the wearer's foot.

Strap members 124 are joined together at their distal ends 126 by a clasping means 140 or by simple typing. Clasping means 140 may be realized by use of Velcro fastening strips adjacent to distal ends 126. In addition, clasping means 140 may be realized in the form of buckle fasteners, snap fasteners, spring fasteners or hooks. The enumeration of such clasping means is not to be construed as inclusive, but only to point out typical examples.

Figure 6:
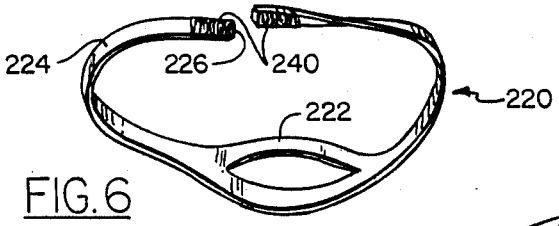
FIG. 6 is a perspective view of a second embodiment of a shoe sling constructed in accordance with the present invention.

Referring to FIG. 6, a second embodiment of a shoe sling according to the present invention is shown in a perspective view, and generally designated 220.

Shoe sling 220 comprises a single loop member 222 and a pair of strap members 224. Strap members 224 are attached to loop member 222 in substantially opposing relation to each other, as illustrated in FIG. 6. A clasping means 240 is attached to strap members 224 at a location adjacent to the distal ends 226 of strap members 224.

Single loop member 222 is configured and dimensioned to slip over and engage heel 30. Strap members 224 are configured and dimensioned to extend from loop 222 around opposing sides of shoe 28 and over the wearer's foot while seated in shoe 28. As with the first embodiment, distal ends 226 of strap members 224 are clasped together or tied together to secure the wearer's foot to shoe 28.

Figure 9:
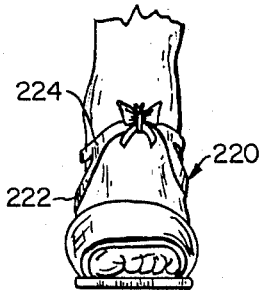
FIG. 9 is a front elevation view of the second embodiment constructed and employed in accordance with the present invention.

FIG. 9 shows a front elevation view of shoe sling 220 employed with shoe 28. Loop member 222 and strap members 224 are shown in place securing the foot to shoe 28.

Figure 8:
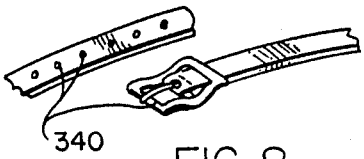
FIG. 8 is an enlarged fragmentary view showing an alternative clasping means for joining the strap member together.

FIG. 8 is an enlarged fragmentary perspective view of one embodiment of a typical clasping means according to the present invention. In FIG. 8, a buckle fastener 340 is shown.

Figure 7:
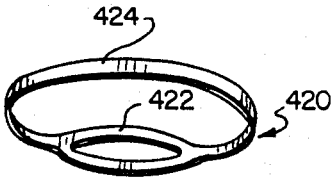
FIG. 7 is a perspective view of the second embodiment of the present invention showing a single continuous strap member.

FIG. 7 is a variant of the second embodiment of the shoe sling according to the present invention, and is designated generally 420. The varying feature is that a single strap member 424 is used, rather than a pair of strap members. Strap member 424 is connected to a loop member 422 at its ends, as shown in FIG. 7.

Shoe sling 420 is applied to shoe 28 by first slipping loop member 422 over heel 30, while strap member 424 is positioned to the rear of shoe 28. Strap member 424 is then pivotally displaced from its rear position to an engaged position over sole 34. The shoe wearer's foot may now be inserted into shoe 28 by first passing the foot under engaged strap member 424.

Figure 13:
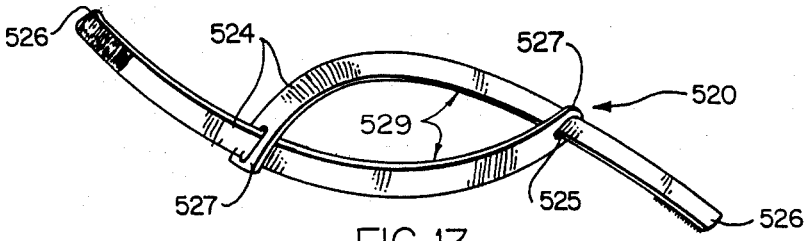
FIG. 13 is a perspective view of the third embodiment of the present invention.

In FIG. 13, a perspective view of a third embodiment of the present invention is shown, and designated generally 520. Shoe sling 520 comprises a coupling arrangement of a pair of strap members 524. Each strap 524 contains a hole 525 therein, located adjacent to a proximate edge 527 to strap members 524. Strap members 524 are coupled together as shown in FIG. 13. A distal edge 526 of one of the strap members 524 is threaded through hole 525 of the other strap member 525. Likewise, distal edge 526 of the other strap member 524 is threaded through hole 525 of the first mentioned strap member 524, producing a noose-like loop 529.

Figure 12:
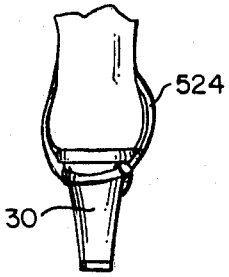
FIG. 12 is a rear elevation view of the third embodiment constructed and employed in accordance with the present invention.
Figure 10:
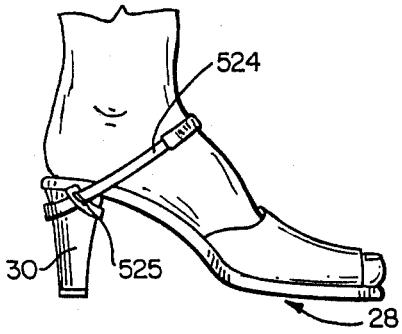
FIG. 10 is a side elevation view of a third embodiment of a shoe sling constructed and employed in accordance with the present invention.
Figure 11:
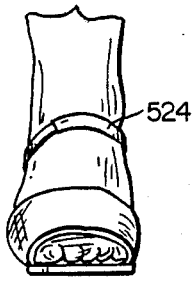
FIG. 11 is a front elevation of the third embodiment constructed and employed in accordance with the present invention.

The inventive shoe sling 520 is employed with shoe 28 as shown in the elevation views of FIGS. 10, 11 and 12. In application, noose-like loop 529 engages heel 30, and strap members 524 are pulled up and around shoe 28 and the shoe wearer's foot. Strap members 524 are then clasped together. As strap members 524 are pulled, noose-like loop 529 tightens snugly around heel 30. The inventive shoe sling 520 is fabricated from the same type of materials as described for the other embodiments.

Figure 17:
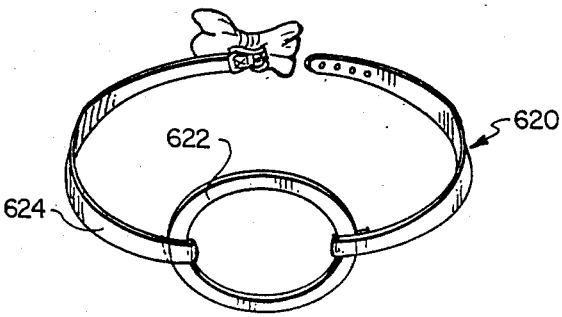
FIG. 17 is a perspective view of the fourth embodiment of the present invention.

FIG. 17 is a perspective view of a fourth embodiment of the inventive shoe sling, according to the present invention, and is designated generally 620. A shoe sling 620 contains a loop member 622 and a pair of strap members 624. Strap members 624 are slidably coupled to loop member 622 such that strap members 624 are capable of being displaced circumferentially about loop member 622 to assume a multiplicity of positions. Generally, when employed with shoe 28, strap members 624 are positioned in substantially opposing relation about loop member 622, as illustrated in FIG. 17.

Figure 16:
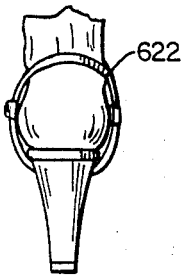
FIG. 16 is a rear elevation view of the fourth embodiment constructed and employed in accordance with the present invention.
Figure 14:
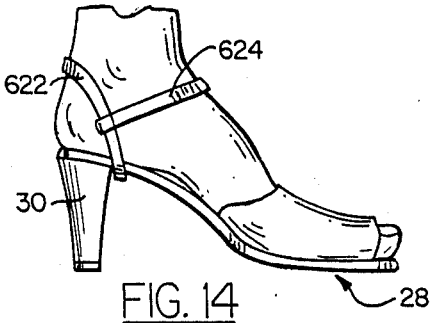
FIG. 14 is a side elevation view of a fourth embodiment of the shoe sling constructed and employed in accordance with the present invention.
Figure 15:
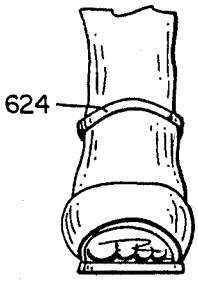
FIG. 15 is a front elevation view of the fourth embodiment constructed and employed in accordance with the present invention.

FIGS. 14, 15 and 16 illustrate elevation views of shoe sling 620 employed with shoe 28. Application of shoe sling 620 to shoe 28 and to the wearer's foot, is accomplished in a substantially similar fashion as described for shoe sling 220 - the second embodiment according to the present invention. As shown in FIG. 14, loop member 622, when applied to shoe 28 and the wearer's foot, engages heel 30 and the heel of the wearer's foot. The inventive shoe sling 620 is fabricated from the same type of materials as described for the other embodiments.

Typical embodiments of the present invention have been described herein and shown in the accompanying drawings to illustrate the underlying principles of the invention, but it is to be understood that numerous modifications may be made to the structure and methods herein disclosed without departing from the broad spirit and scope of the invention.

I claim:

1. A universal shoe sling for employment with a conventional shoe, comprising;

(a) a pair of loop-shaped members for slidably engaging the heel of said shoe; and (b) means, cooperating with said pair of loop-shaped members, for strapping a shoe wearer's foot to said shoe.

2. A shoe sling as recited in claim 1, wherein said strapping means comprises a pair of strap members each having first and second ends, each of said first ends being connected to one of said loop-shaped members, said pair of strap members being positioned, configured and dimensioned to wraparound said foot and said shoe.

3. A sling as recited in claim 1, wherein said strapping means comprises a strap member having a pair of ends, each of said ends being connected to one of said loop-shaped members, said strap member being positioned, configured and dimensioned to wraparound said foot and said shoe.

4. A shoe sling as recited in claim 2, wherein said second ends of said strap members have a clasping device associated therewith to enable said strap members to be joined together at said second ends.

5. A shoe sling as recited in claim 4, wherein said clasping device comprises a Velcro fastener.

6. A shoe sling as recited in claim 4, wherein said clasping device comprises a snap fastener.

7. A shoe sling as recited in claim 4, wherein said clasping device comprises a buckle fastener.

8. A universal shoe sling for employment with a conventional shoe, comprising a pair of strap members each having first and second ends thereto, each of said strap members containing a hole therein adjacent to its first end, each of said strap members being inserted through the hole of the other such as to form a noose-like loop for slidably engaging the heel of said shoe, said noose-like loop tightens around said heel when the second ends of said strap members are pulled, said pair of strap members being positioned, configured and dimensioned to wraparound said foot and said shoe.

9. A shoe sling as recited in claim 8, wherein said second ends of said strap members have a clasping device associated therewith to enable said strap members to be joined together at said second ends.

10. A shoe sling as recited in claim 9, wherein said clasping device comprises a Velcro fastener.

11. A shoe sling as recited in claim 9, wherein said clasping device comprises a snap fastener.

12. A shoe sling as recited in claim 9, wherein said clasping device comprises a buckle fastener.

13. A shoe sling as recited in claim 9, wherein said clasping device comprises a spring fastener.

14. A shoe sling as recited in claim 9, wherein said clasping device comprises a hook fastener.

15. A method of securing a conventional shoe to a foot of a wearer of said shoe, employing first and second strap members, each having first and second ends and each having a hole contained therein adjacent to its respective first end, said method comprising the steps of:

threading said first strap member through the hole of said second strap member;

threading said second strap member through the hole of said first strap member, to form a noose-like loop;

slidably engaging the heel of said shoe with said noose-like loop;

pulling the second ends of said first and said second strap members to tighten the noose-like loop around the heel of said shoe; and wrapping said first and said second strap members around the wearer's foot and the shoe.

16. A universal shoe sling for employment with a conventional shoe, comprising:

(a) a loop-shaped member; and (b) a pair of strap members each having first and second ends, said first ends of said strap members being coupled to said loop-shaped member such that said strap members are capable of being displaced circumferentially about said loop-shaped member to assume a multiplicity of positions, said pair of strap members being positioned, configured and dimensioned to wrap-a-round said foot and said shoe.

17. A shoe sling as recited in claim 16, wherein said second ends of said pair of strap members have a clasping device associated therewith to enable said strap members to be joined together at said second ends.

18. A shoe sling as recited in claim 17, wherein said clasping device comprises a Velcro fastener.

19. A shoe sling as recited in claim 17, wherein said clasping device comprises a buckle fastener.

20. A shoe sling as recited in claim 17, wherein said clasping device comprises a snap fastener.

* * * * *